US005511903A

United States Patent [19]

Nichols et al.

[11] Patent Number: 5,511,903

[45] Date of Patent: Apr. 30, 1996

[54] LEACHING CHAMBER WITH PERFORATED WEB SIDEWALL

[75] Inventors: James M. Nichols, Old Saybrook; Bryan A. Coppes, Westbrook; Bruce T. Sperry, Jr., Norwich, all of Conn.

[73] Assignee: Infiltrator Systems, Inc., Old Saybrook, Conn.

[21] Appl. No.: 316,946

[22] Filed: Oct. 3, 1994

[51] Int. Cl.[6] ..... E02B 11/00

[52] U.S. Cl. ..... 405/43; 405/36; 405/46; 405/49

[58] Field of Search ..... 405/36, 43, 44, 405/46, 48, 49, 53

[56] References Cited

U.S. PATENT DOCUMENTS

| | | | |
|---|---|---|---|
| 3,579,995 | 5/1971 | Flynn | 405/46 |
| 3,820,341 | 6/1974 | Richard et al. | 405/46 |
| 4,192,628 | 3/1980 | Gorman | 405/46 X |
| 4,245,924 | 1/1981 | Fouss et al. | 405/43 X |
| 4,759,661 | 7/1988 | Nichols et al. | 405/48 |
| 4,950,103 | 8/1990 | Justice | 405/43 |
| 5,017,041 | 5/1991 | Nichols | 405/48 |
| 5,046,892 | 9/1991 | Kothmann | 405/43 |
| 5,087,151 | 2/1992 | Di Tullo | 405/43 |
| 5,156,488 | 10/1992 | Nichols | 405/48 |
| 5,336,017 | 8/1994 | Nichols | 405/46 |

*Primary Examiner*—Eric K. Nicholson
*Assistant Examiner*—John A. Ricci
*Attorney, Agent, or Firm*—C. G. Nessler

[57] ABSTRACT

A molded plastic leaching chamber, for dispersing or collecting liquids in soil, has a corrugated arch shape. The sidewall of the chamber is comprised of alternating slot-perforated peaks and valleys connected by slot-perforated deep webs. The unit surface length of perforated sidewall is greater than the unit length of chamber. A combination of interrelated dimensions and angles provide high leaching capacity, strength, and capability to nest for shipment. The sidewall is reinforced by vertically running ribs; the perforated web is reinforced by zig-zag struts. Ribs and struts are shaped and positioned to minimize blockage of the slot openings.

27 Claims, 5 Drawing Sheets

LEACHING CHAMBER WITH PERFORATED WEB SIDEWALL

FIELD OF INVENTION

The present invention relates to dispersion or collection of liquids within soil, more particularly to arch shaped chambers having perforated sidewalls.

BACKGROUND

To disperse the effluent from storm drains and subsurface sewage disposal systems within the earth, use has been made of covered pits ("dry wells ") and perforated pipes set in gravel filled trenches, along with preformed concrete structures having sidewall and bottom holes. Within the last decade, molded plastic arch shaped leaching chambers (also referred to as leaching conduits) sold under the registered U.S. trademark "Infiltrator", have met substantial commercial success. Examples of such type of chambers are shown in U.S. Pat. No. 4,759,661 to May and Nichols; and, in U.S. Pat. Nos. 5,017,041, 5,156,488 and 5,336,017 all to Nichols. All of the foregoing patents have an inventor and assignee in common herewith. The Nichols type of commercial chambers are generally arch shaped, have open bottoms, sidewalls corrugated for strength, and have sloped sidewalls with a multiplicity of slotted perforations. They typically are 190 cm long by 86 cm wide and 30–45 cm high.

Generally, such molded chambers are placed end-to-end in a trench and then covered over with soil. Liquid is piped into the chamber system and passes through the open bottom and perforated sidewalls, into the soil. A biological membrane, also called a biomat, forms in the soil near the perforations, and limits the per unit area flow of liquid into the soil. Thus, high degrees of perforations are desired, to increase the leaching capacity of a chamber. Leaching chambers with high flow rating will desirably require the less trench length, fewer chambers, and thus lower cost.

However, there are several design factors competing with the objective of maximum liquid dispersal. They include: The sidewall must resist vertical and sideways forces. The sidewall openings must limit entry of the surrounding soil into the chamber. The chamber base must provide sufficient bearing area on the underlying soil, to resist the weight of earth and any vehicles passing over the soil above. The chamber design must be straightforward and economic to manufacture. Chambers must efficiently nest each within the other for economic shipment and handling. Further, molded plastic chambers must technically and economically compete with stone filled trenches, pre-cast concrete galleries, and other prior art devices. Thus, designers of chambers have sought to maximize the open area in the peaks and valleys, maximizing the number of openings, and placing the slots as far vertically upward on the sidewalls as possible. But there is still need for better performing chambers.

SUMMARY

An object of the invention is to provide a leaching chamber with increased sidewall leaching capacity; in particular, to provide a chamber with substantially greater leaching capacity per unit chamber length. A further object is to provide chambers having webs that contribute to leaching capacity, but wherein the webs still perform their necessary structural function. Another object of the invention is to provide a chamber with a combination of dimensions and angles which maximizes the liquid dispersing capacity of a chamber, but which at the same time provides strength, makes economic the manufacture and shipping of chambers as nested units. A still further object of the invention is to provide a chamber with a sidewall having strengthening ribs that are readily moldable, but which minimally obstruct the leaching area provided by sidewall perforations.

According to the invention, a chamber for dispersing or gathering liquids in soil has an arch shape cross section; it is corrugated, with alternating peak and valley corrugations running along the arch shape, where webs connect the adjacent peaks and valleys; and, the sidewalls of the webs have perforations, in addition to the perforations of the peaks and valleys. The typical unit length of sidewall has perforated portions that in total are greater in length than the point-to-point length.

In the preferred invention, a web has slotted perforations and one or more diagonal struts run across the web, from the intersection of the web with the peak to the intersection of the web with the valley, to strengthen the web when there is a high degree of perforation. Preferably, there are upwardly running T-shape cross section ribs near the intersections of a web with adjacent peak and valley, and at the center points of the peaks and valleys. Most preferably, the rib at the intersection of the web and peak is displaced longitudinally a short distance, along the chamber length, away from the intersection and toward the center of the peak.

In further accord with the invention, a chamber has an Infiltration Area (IA) to Total Area (TA) ratio of greater than 0.62, preferably more than 0.7, where IA is the hypothetical soil infiltration area provided by the slots and where TA is the area of the surface of the chamber sidewall.

In still further accord with the invention, a chamber has a novel set of interrelated sidewall feature dimensions and angles, to provide substantially greater sidewall leaching area than heretofore while efficiently meeting other design criteria. In one aspect, the ratio j/k of a chamber is at least 0.35, preferably more than 0.45, most preferably more than 0.7, where j is the valley depth and k is the peak length, as both are measured at the chamber mid-elevation horizontal plane and are as shown in FIG. 6. In another aspect, the ratio of j/l is at least 0.053, preferably more than 0.060, most preferably more than 0.085, where l is the one meter unit length of chamber; and, the ratio k/L is less than 0.08, preferably less than 0.07, most preferably less than 0.06, where L is the overall chamber length. In yet another aspect of the invention, the chamber angles are as follows:

- a typical web has a web sidewall angle B of 12–20degrees, preferably 15–20degrees, where angle B is the angle between a vertical cross sectional plane of the chamber and the angle of the surface of the web, measured at the plane of the chamber base;
- a typical peak has a sidewall angle of $\phi$ 15–20 degrees, where the angle $\phi$ is the angle between the peak sidewall exterior surface and a longitudinal plane of the chamber; and,
- a typical web has a peak-web intersection angle S of 9–15 degrees, preferably 9–10 degrees, where the angle S is the angle between the web-peak intersection and the vertical cross section plane of the chamber.

The improved chambers provide superior liquid dispersal character when in use, and at the same time resist well the stresses imposed. At the same time, they are economic to manufacturer and because of their good nesting, economic to ship.

The foregoing and other objects, features and advantages of the invention will become more apparent from the following description of the best mode of the invention and accompanying drawings.

DESCRIPTION

The invention is described in terns of improvements to a chamber made generally in accord with the descriptions of the commonly assigned patents mentioned in the Background, the disclosures of which are hereby incorporated by reference. The term "chamber" is used here in place of "conduit" in prior art patents.

A preferred chamber is arch shaped and has an open bottom; it is about 190 cm long, 56–86 cm wide at the base, and 30–66 cm high. The chamber is made of high density polyethylene using a gas assisted injection molding technique, generally in accord with the technology described in U.S. Pat. Nos. 4,247,515, 4,234,642 and 4,136,220 all to Olabisi, and No. 4,101,617to Friedrich. The process and constructions described in commonly assigned U.S. Pat. No. 5,401,459 of Nichols and Moore, are used. The disclosures of the foregoing patents and application are hereby incorporated by reference. Thus, during molding, gas is injected to displace part of the plastic and form a chamber having hollow ribs and other larger cross section parts. The chamber may be fabricated in alternate ways, for example, it may be made of structural foam, by conventional injection molding, etc.

Figure 1:
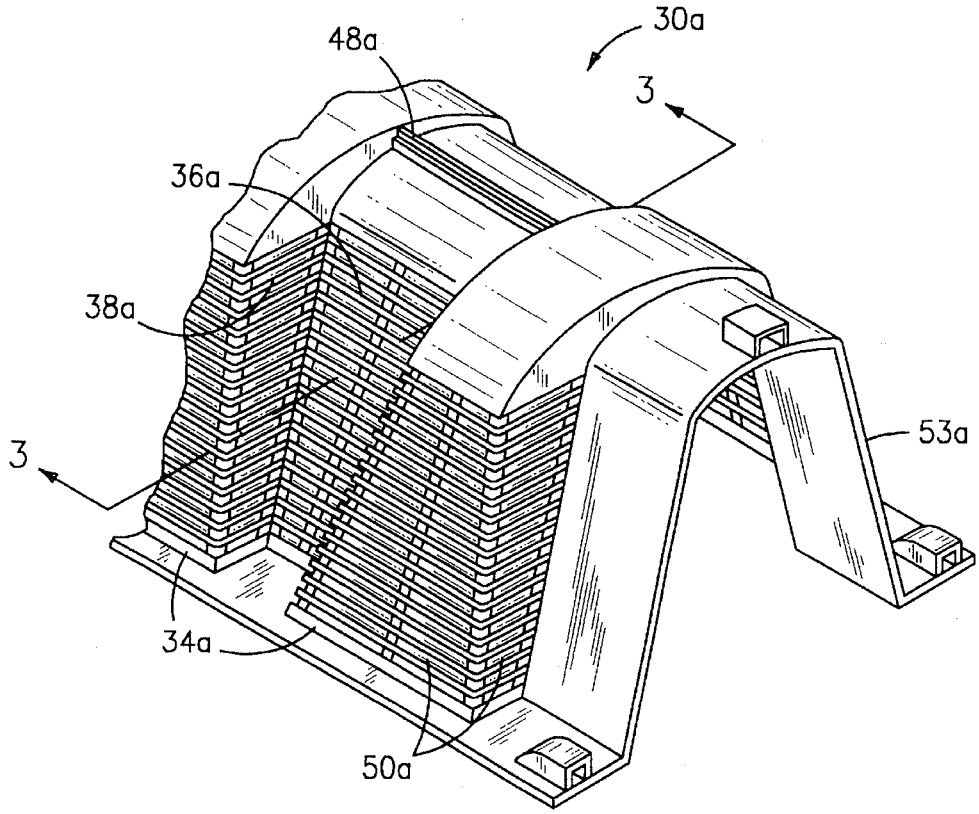
FIG. 1 is a perspective view of a leaching chamber of the present invention.
Figure 3:
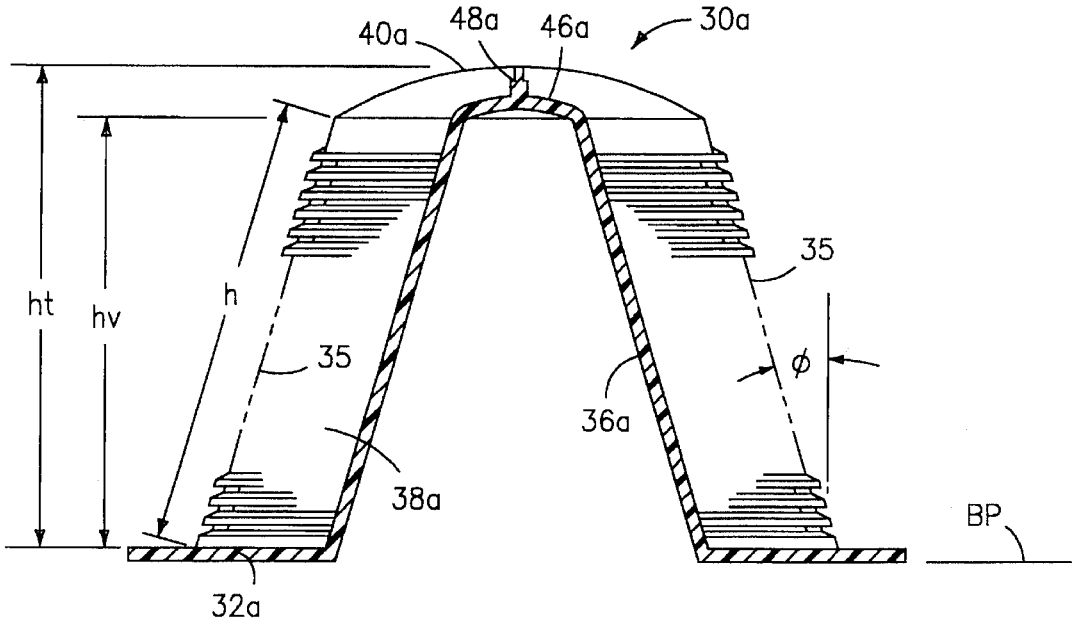
FIG. 3 is an end cross sectional view of a chamber like that shown in FIG. 1.
Figure 2:
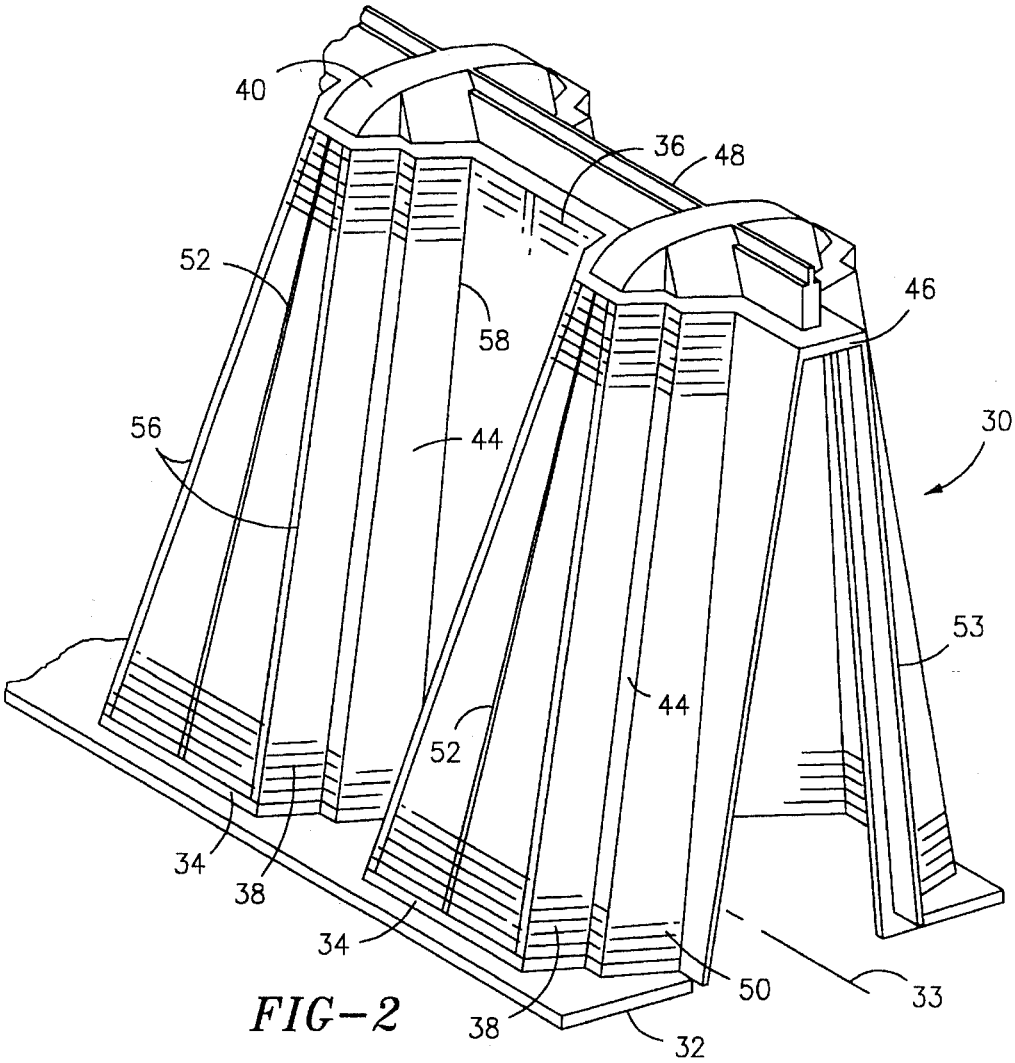
FIG. 2 is a perspective view of another leaching chamber of the present invention, having a different aspect ratio and stepped web sidewalls, compared to that of FIG. 1.
Figure 4:
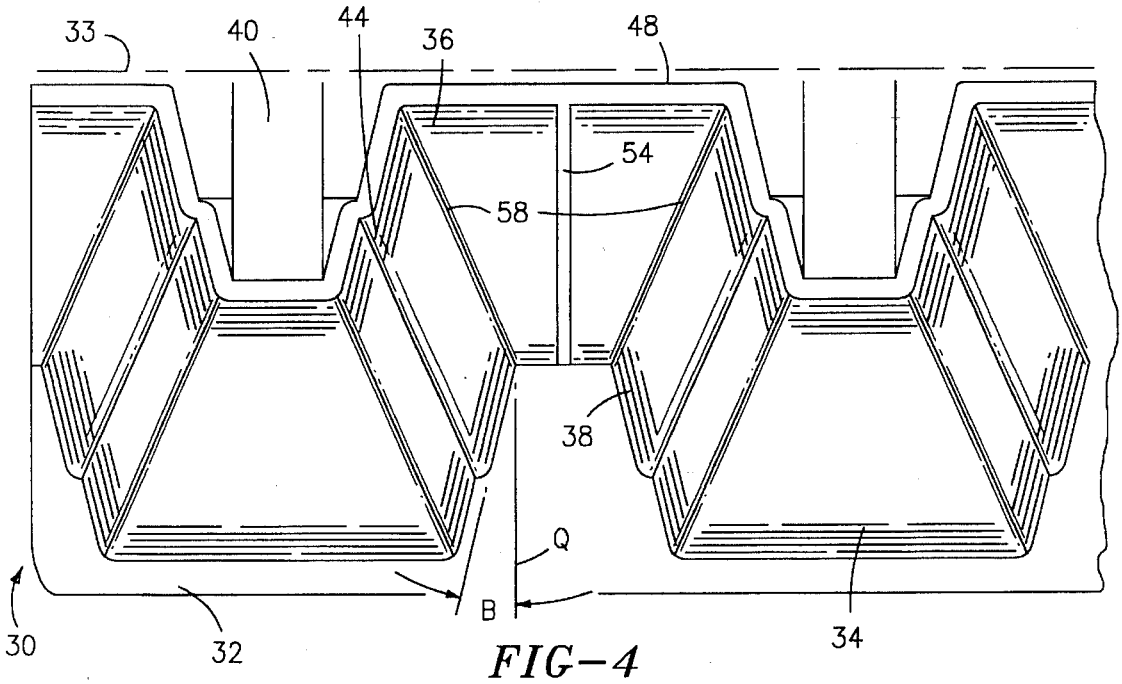
FIG. 4 is a top view of the chamber shown in FIG. 2.

FIG. 1 is a perspective view of part of a chamber 30*a*. FIG. 3 is a cross section view of the FIG. 1 chamber. FIG. 2 is perspective view of part of a chamber 30, of somewhat different shape, having many features similar to those of chamber 30*a*. FIG. 4 is a partial top view of the FIG. 2 chamber. The chambers 30, 30*a* are described together; common features of these and other embodiments indicated by the correspondence between the plain numbers and the numbers having suffixes. In the tabular data which follows, the inventive chamber designated EQ-24 generally looks like chamber 30*a;* while the inventive chamber designated SW-24 generally looks like chamber 30.

The chambers are corrugated and the corrugations are comprised of alternating sections: peaks 34, 34*a* and valleys 36, 36*a*, running along the arch shape cross section. Adjacent peaks and valleys are connected by webs 38, 38*a*.

Figure 8:
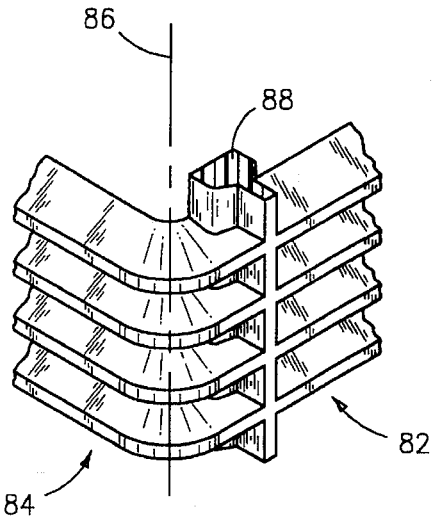
FIG. 8 is a perspective view of the corner intersection of a web and peak, showing how the rib there is displaced longitudinally along the peak.

Horizontal slots 50, 50*a* run along the sidewalls of the peaks, valleys, and webs of the chambers. The slots are overlaid and defined by spaced apart louvers shown in FIG. 8, 9A and 9B, as discussed in more detail below.

Figure 5:
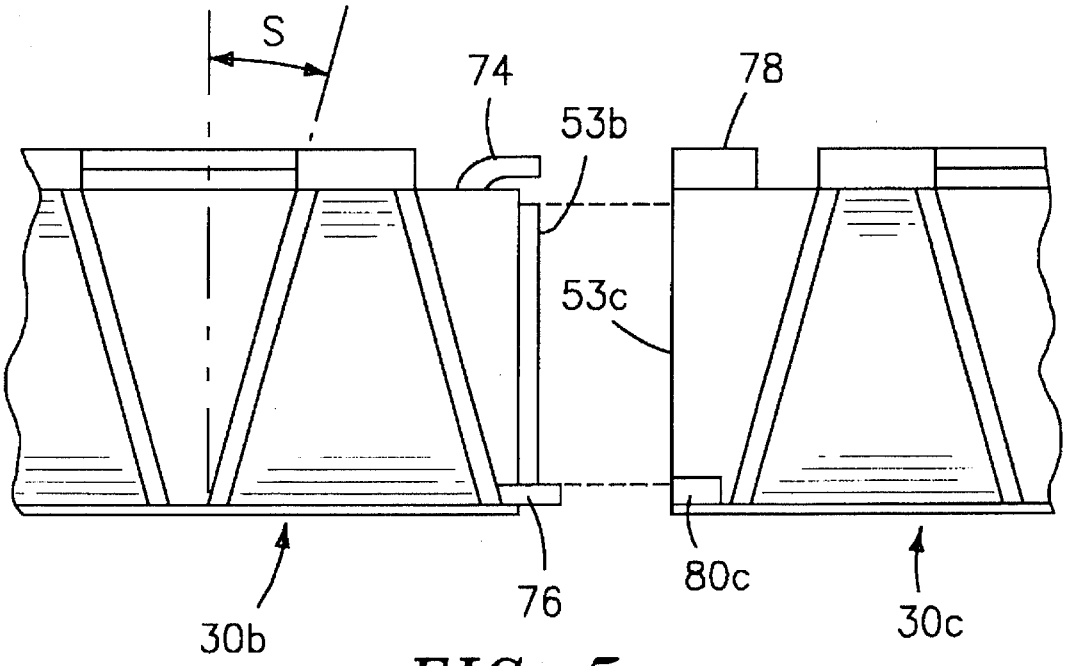
FIG. 5 is a side elevation view showing the how two chambers mate and interlock with each other, along with angle S.

The chambers have open ends 53, 53*a*. Shown on chamber 30*a* are latches, and there are mating surfaces at opposing chamber ends, so that chambers may be fastened together firmly with load transfer. For example, FIG. 5 shows how the ends 53*b*, 53*c* of two chambers 30*b*, 30*c* mate with a shiplap joint like that of the prior art. A prong or leg 74 at the top of the arch at the end of chamber 30*b* engages and latches into mating pocket 78 at the end of chamber 30*c*. A leg 76 at the base of chamber 30*b* likewise engages the pocket 80 at the base of chamber 30*c*. There is an unseen similar leg and pocket on the the opposing side of the base. See FIG. 1. The legs described in the aforementioned Nichols patents may also be used.

The chamber 30*a* is shown in end view cross section in FIG. 3. Each peak has opposing straight sidewalls 35, and an upwardly curved arc shape peak top 40*a*. Other top shapes, including flat tops may be used. The top of valley 36*a* has a stiffening rib 48*a*. Other strengthening ribs running lengthwise and crosswise, run along the interior and exterior, may be used, in accord with the prior art. Chamber base 32*a* is flat and is sized to provide sufficient bearing load area upon the soil. In cross section, typical valley section 36*a* may be characterized as being shaped substantially as a triangle with a truncated apex 46*a;* alternately, it may be characterized as substantially a trapezoid. The peak and valley portions of the sidewall are trapezoidally shaped planes. The web sidewalls are nominally parallelograms; they will be trapezoids when the arch shapes of the peak and valley are not congruent.

The chamber dimensions and angles are complexly interdependent and are chosen to achieve the objects of the invention, taking into account the factors mentioned in Background. FIG. 1–6 and Table 1 detail important dimensional and angle features of the preferred invention chambers, along with those of typical prior art chambers. In the invention, slots in the peak, valley, and web sidewalls are present to an elevation hv; alternately, they may be described as running a distance h from the base, as measured along the sidewall slope. See FIG. 3.

FIG. 4 shows how typical web 38 makes a web sidewall angle B with a vertical cross section plane (indicated by reference line Q), measured at the elevation of the base plane BP shown in FIG. 3. Preferably, the angle B is 10–30 degrees, more preferably 15–25, most preferably 15–20 degrees. Whenever a cross section or cross section plane is mentioned without qualification herein, it is a reference to the section or plane which is perpendicular to the longitudinal axis 33 of the chamber.

With reference to FIG. 3, the sidewall slope angle $\phi$ of the typical peak (and valley) sidewall with the vertical longitudinal plane of the chamber is preferably 10–30 degrees, more preferably 10–20, most preferably 15–20 degrees.

With reference to FIG. 5, the angle S of the intersection of the typical web and valley (and intersection of the web and peak) with a cross section plane of the chamber is 2–15 degrees, more preferably 7–15, most preferably 9–10 degrees.

When the sidewalls are not planar, then the slope or angle of such will be determinable as the average or nominal plane of inclination of the structure being measured.

TABLE 1

Nominal Angles and Dimensions of Chambers.

| | Degrees | | | Centimeter | | |
|---|---|---|---|---|---|---|
| Product | S | B | Ø | L | ht | wb |
| PRIOR ART | | | | | | |
| STD-5 | 2 | 11 | 20 | 191 | 30 | 86 |
| HC-5 | 2 | 11 | 20 | 191 | 41 | 86 |
| B/LB | 8 | 0 | 20 | 191 | 28 | 86 |
| B/S | 8 | 0 | 20 | 191 | 33 | 86 |
| STD-5SF | 7 | 11 | 20 | 191 | 30 | 86 |
| HC-5SF | 6.5 | 10 | 18.5 | 191 | 38 | 86 |
| PREFERRED INVENTION | | | | | | |
| SW-5 | 11 | 15 | 20 | 191 | 30 | 86 |
| SW-24 | 10 | 20 | 15 | 191 | 66 | 56 |
| EQ-24 | 10 | 15 | 15 | 244 | 28 | 41 |

Figure 6:
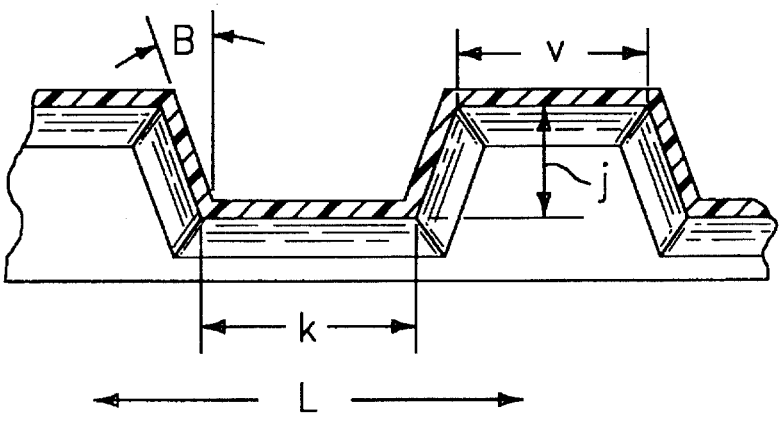
FIG. 6 is a horizontal plane section at mid-elevation of a schematic chamber side wall to show the character of peak and valley dimensions.

FIG. 6 shows in a plan view a part of a chamber sidewall, where the cross section is for a horizontal plane at the midpoint of the slope elevation h of the perforated part of the sidewall. The valleys have a depth j; the peaks have a length k; and, the valleys have a length v. In the invention, the depth, j, of the valley is made deeper than heretofore, and since the web is thus wider, the web is efficiently provided with slots. Previously, the web has been made relatively shallow, with a small angle B, to minimize material cost and maximize valley length v, and thus valley leaching area. The prior art web was not suited for slots, being too narrow; and, the web must provide important structural support for resisting vertical and lateral loads.

Valley depth j (and the corresponding web sidewall width) is parametrically related to the other dimensions, especially peak width k; and the interrelations are significant in achieving the objects of the invention. The ratio j/l (where l is a one meter unit length of the chamber) is a measure of the severity of corrugation depth. The ratio j/k is a measure of the severity and peroidicity of corrugation. Typically, a chamber will have 6 corrugations (6 peaks and 5 valleys), less preferably 5 corrugations (5 peaks and 4 valleys); along with partial unperforated valleys at each end. Thus, the k will tend to be a step function; and, the ratio k/L (where L is the total length of the chamber) is a reflection of pitch of the corrugation and angles S and B. Typically, peak length k will be equal to the adjacent valley length dimension v; but when they are unequal, for purposes of the claims to this invention, k will be determined by averaging a typical peak and valley dimension.

Table 2 shows dimensions and parametric ratios for the invention, at said midpoint elevation plane, and compares them to prior art. It is seen that the invention is in a different realm in several respects. In the invention, the depth ratio j/k is preferably greater than about 0.35; more preferably more than 0.45; most preferably more than 0.7. The ratio j/1 is preferably greater than 0.053; more preferably more than 0.06; most preferably more than 0.08. The ratio k/L is preferably less than 0.08; more preferably less than 0.07; most preferably less than 0.06 .

TABLE 2

Chamber dimensions (cm) and parametric ratios, with reference to FIG. 6.

| Product | j | k | L | j/k | j/l | k/L |
|---|---|---|---|---|---|---|
| PRIOR ART | | | | | | |
| STD-5 | 5.08 | 16.94 | 191 | 0.30 | 0.051 | 0.089 |
| HC-5 | 5.08 | 17.15 | 191 | 0.30 | 0.051 | 0.090 |
| STD-5SF | 5.18 | 15.88 | 191 | 0.33 | 0.051 | 0.083 |
| HC-5SF | 5.18 | 15.24 | 191 | 0.34 | 0.051 | 0.080 |
| B/LB | 4.42 | 18.42 | 191 | 0.24 | 0.044 | 0.097 |
| B/S | 4.65 | 18.26 | 191 | 0.25 | 0.047 | 0.096 |
| INVENTION | | | | | | |
| SW-5 | 8.64 | 10.85 | 191 | 0.80 | 0.086 | 0.057 |
| SW-24 | 10.87 | 13.49 | 191 | 0.81 | 0.109 | 0.071 |
| EQ-24 | 6.50 | 13.41 | 244 | 0.48 | 0.065 | 0.055 |
| General | | | | >0.35 | >0.053 | <0.08 |
| Preferred | | | | >0.45 | >0.060 | <0.07 |
| Most Preferred | | | | >0.7 | >0.085 | <0.06 |

With respect to the sidewall dimensions, it will be observable that the length of the sidewall, as measured along the exterior surface of the chamber, is greater than the length of the chamber, owing to the corrugation of the sidewall surface. However, consider as a unit length a full corrugation subsection, e.g., from a point on a peak to the corresponding point on the next peak—a subsection that does not include an unperforated end partial-valley: In prior art chambers the cumulative length of the sidewall parts which were perforated was less than the point to point length of the chamber. In comparison, in the invention the length of perforated portion of sidewall is greater than the length of chamber, due to the presence of perforations in the webs and the choice of other angles and dimensions.

Figure 7:
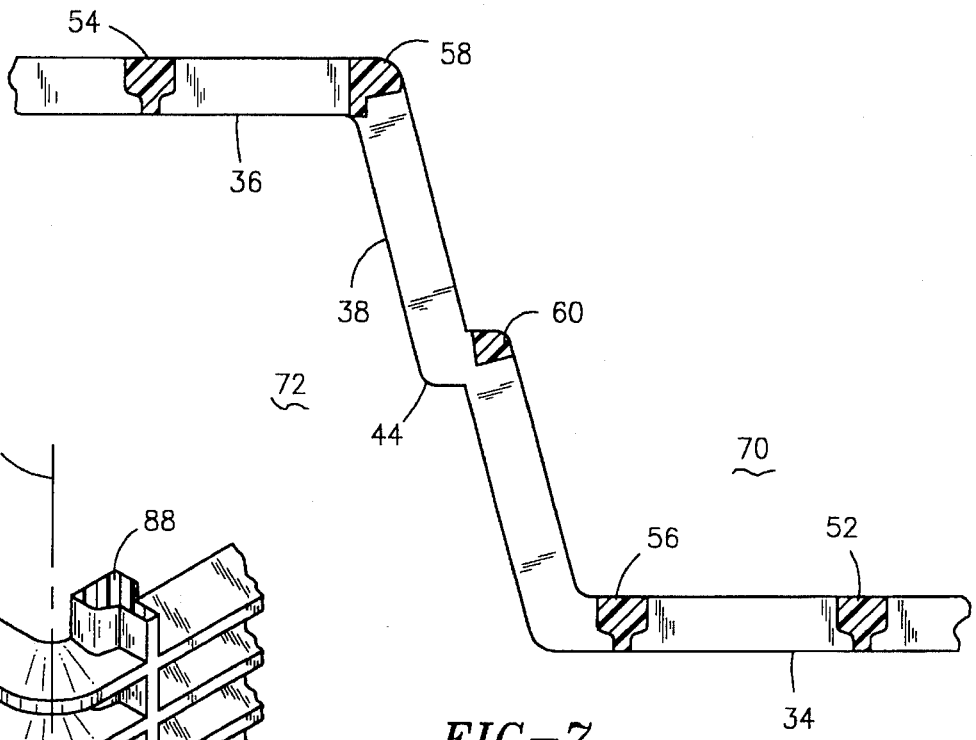
FIG. 7 is a a horizontal plane section through a part of the sidewall of a chamber like that shown in FIG. 2, showing the upwardly running rib shapes.

The chamber 30 has a multiplicity of ribs running vertically up its opposing sidewalls, to improve resistance to vertical and lateral loads. See FIG. 2, and FIG. 7 which show a horizontal midplane cross section of a portion of sidewall of typical chamber. Rib 56 runs vertically proximate the intersection of the web 38 and peak 34. Rib 52 runs along the center of the peak 34. Ribs 58 run along the opposing intersections of the valley 34 and adjacent webs. Still another rib 54 runs up the center of the valleys. The ribs 52, 54, 56, 58 are shaped and positioned to maximize the infiltration area and IA/TA ratio, discussed below, and have a nominal T-shape cross section with the base of the T facing outward. The rib cross section minimizes blockage of the slots at their exits and facilitates manufacture, with respect to the drawing away of dies from the sidewall exterior. In FIG. 7 the interior 70 of the chamber corresponds with the core or male part of the die, while the exterior 72 corresponds with a female part of the die. After molding, the female part of the die is drawn away from the exterior surface, moving in the plane of the Figure. The other rib features described below will be understood in the same context.

When the web is especially deep or strength requirements otherwise demand it, a vertical rib 60 runs up the center of the web. As shown in FIG. 4 and 7, the step 44 in the center of web 36 enables a desired shape for rib 60, so the rib does not intersect the exterior surface of the web. Thus, the perforation exit opening is desirably kept clear, to improve leaching, while undue die cost and complexity are avoided.

Were it not for the step, to accomodate straightforward drawing away of the sidewall-defining die, the rib 60 would necessarily have a long oblique shape, in the direction of the draw of the die, from the interior to exterior wall, and would occlude the slots more than in the invention.

The rib 56 proximate the corner where the peak intersects the web is also specially configured and positioned. As illustrated by the fragment of a like chamber, shown in FIG. 8, peak 82 and web 84 intersect at a corner (designated by phantom line 86). The tee-shape rib 88 is spaced apart from the corner intersection, lengthwise along the chamber, and toward the center of the peak. See also FIG. 12. If the rib 88 was positioned right at the intersection 86, then the rib molding constraints would make the rib cross section run part way along the web, and the rib cross section would be considerably greater in depth (as measured perpendicular to the chamber axis).

Figure 11:
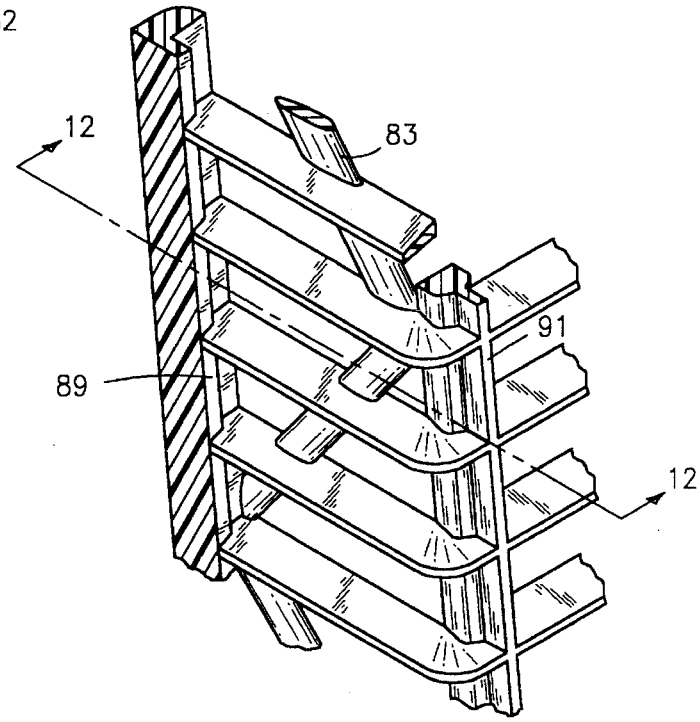
FIG. 11 is a more detail view the structure shown in FIG. 10, showing how the strut lies near the interior of the chamber and web sidewall.
Figure 12:
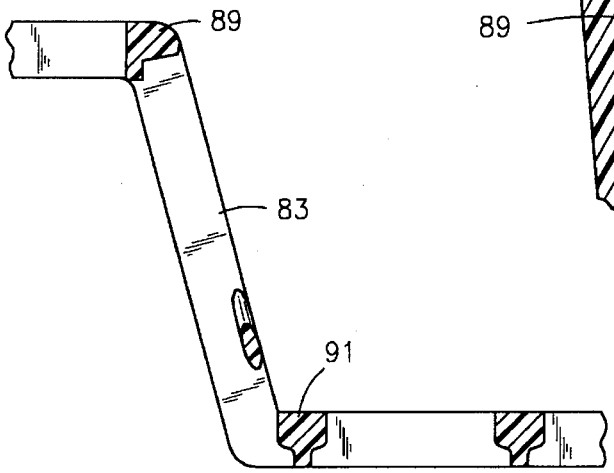
FIG. 12 is similar to FIG. 7, showing the strut at the web sidewall running between the peak-web rib and the valley-web rib.
Figure 10:
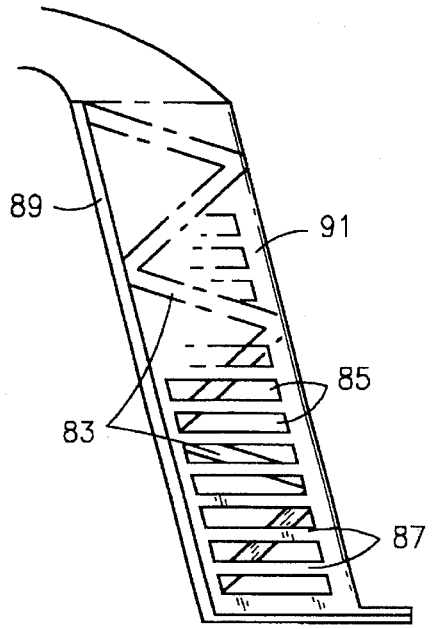
FIG. 10 is a view along the longitudinal axis of a chamber, showing how a slotted web sidewall is reinforced with zig-zag struts.

For the best structural strength, the web part of the sidewall is reinforced as shown in FIG. 10–12. Zig-zag inclined struts 83 are molded into the web sidewall, running from the rib 91 near the web-peak intersection to the rib 89 at the web-valley intersection. The struts 83 and attached ribs thus form a series of adjacent triangles, as shown in FIG. 10. The combination of strut and rib (or plain corner structure when there is no rib) form a truss structure that greatly strengthens the web against the shear forces, among others, that are present due to the vertical and lateral loads imposed during use. As shown in the sidewall portion of FIG. 11, and the horizontal plane cross section of FIG. 12, the struts have an oblong cross section and they are of relatively small size; they are displaced toward the chamber interior, to minimize impediment to flow and affect on perforation area. Other numbers of struts, angled with respect to the slots, 85 and other patterns of strut reinforcement, e.g., diamonds, parallelograms, may be used. The struts may be combined with the stepped sidewall of FIG. 2 and 7, running to and from the center rib 44.

Figure 9A:
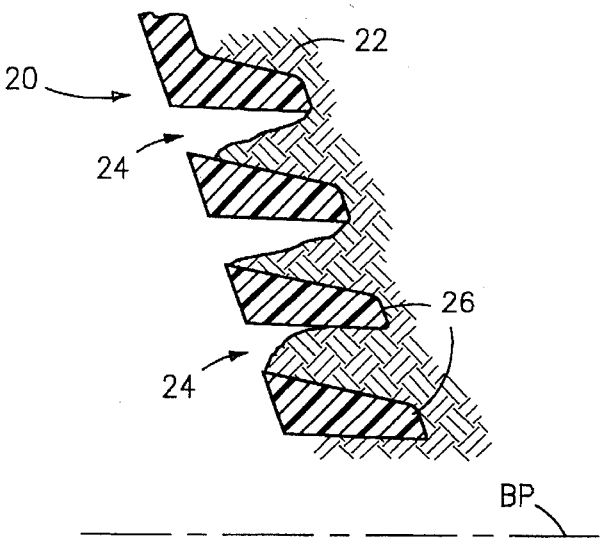
FIG. 9A is a vertical plane section through a portion of a slotted sidewall, showing how soil typically infiltrates the slots.
Figure 9B:
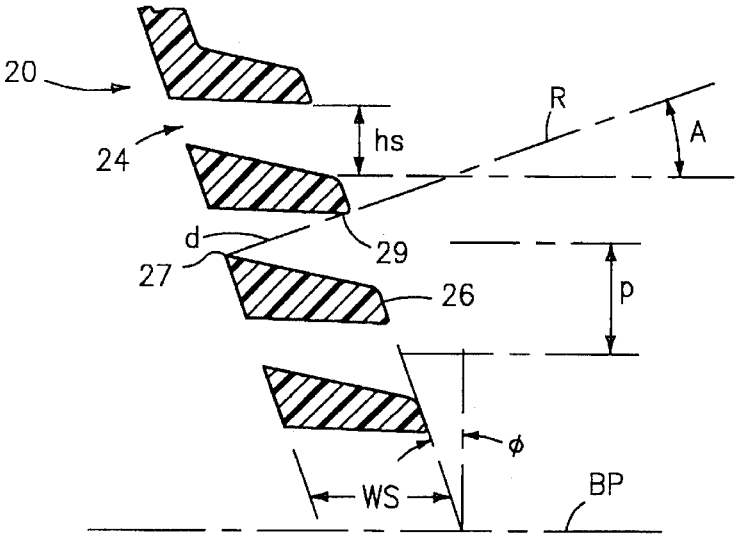
FIG. 9B is a view similar to FIG. 9B, showing dimensional features of a slotted sidewall, including those used to calculate Infiltration Area.

The sidewalls are comprised of slots with integral protective louvers, generally like those of the prior art, as shown in the sidewall fragment cross section of FIG. 9B. The slots have a nominal vertical opening, hs, of about 4.8–6.4 mm, most preferably 6 mm, and a pitch p (centerline-to-centerline spacing) of about 14 mm. The chamber wall thickness ws is about 11–13 mm. The dimension ws is nominally the depth of the slot, or alternately stated, the length of the through-the-wall passage of the slots. Other perforations are within the generality of the invention. For example, a sidewall may have a multiplicity of circular or oval perforations, sloped downwardly with respect to the horizontal plane. Other louver cross section shapes may also be employed, e.g., an L-shape. From a sanitary engineering standpoint, chambers are rated according to the extent to which they provide leaching area, i.e., contact of the liquid with the soil. The invention makes a substantial advance over the prior art in this respect, and the Figures show the parameters which aid comparisons. A chamber has the preforated sidewall dimensions hv and h, a total height, ht, and a length, L, as mentioned above.

In the prior art, where a perforated pipe lies in a stone trench, on each side of the trench the total area of "sidewall" potentially available for leaching is the product of height multiplied by the length of the trench. Where pieces of stone contact the soil of the trench sides, liquid penetration is considered to be "masked" or blocked. Typically, it is considered that masking in a stone trench is about 55 percent of the total area contacted; or, that the area for infiltration into the soil is 0.45 of the total trench sidewall area.

(In this discussion, the contribution of the bottom of the trench or chamber is ignored. Also, it is assumed that invert height will not limit the chamber. Invert height refers to the elevation in the chamber at which a pipe introduces liquid.)

So, to compare arch shape chambers with each other and with stone trenches, the characteristic Total Area, TA, is compared to the characteristic Infiltration Area, IA. TA is defined as the product of the chamber perforated area sidewall slope height, h, and the sidewall unit length, l. The infiltration area, IA, is the hypothetical area of soil which is actually contacted by liquid, and it is determined as follows: It is a function of the amount of soil contacted at each slot that is contacted by liquid from within the chamber, and the total number of slots. FIGS. 9A and 9B illustrate how the hypothetical amount of soil contacted at each slot opening is calculated. FIG. 9A shows in cross section a portion of a sidewall 20 having louvers 26 and slot openings 24. Soil 22 lies against the outside of sidewall. In the field the soil will infiltrate into the slot to an extent dependent on various parameters, including the characteristic angle of repose of the soil, liquid presence, soil loading, variations in parameters over time, etc. To ease a reasonable comparative analysis, it is assumed here that the soil will lie in the slot along the reference line R of FIG. 9B, where the same sidewall segment 20 from FIG. 9A is shown. The line R defines the slightest possible soil slope, angle A, which the slot/sidewall will accomodate; if angle A was hypothetically made smaller, soil would be assumed to be falling into the interior of the chamber. At angle A, soil has a sloped surface length, d, being the length of the reference line R between the inkier opening edge 27 and the outer opening edge 29 of the slot passageway 24. For the preferred sidewalls and louvered slots, angle A will be about 20–40 degrees.

Thus, for the sidewall segment shown in FIGS. 9A, 9B, the nominal infiltration area, IA, will be the substation of the products of dimension d multiplied by the slot width (dimension parallel to the chamber longitudinal axis), for all the slot openings. Since the invention has slotted webs and an optimized set of dimensions and angles, the invention provides a greatly increased ratio of IA/TA, compared to the prior art. This is illustrated by the data in Table 3.

TABLE 3

Nominal sidewall height, area and IA/TA ratio for chambers.

| Product | ht (cm) | h (cm) | Infiltration Area (IA) (sq cm) | Total Area (TA) (sq cm) | IA/TA ratio |
|---|---|---|---|---|---|
| PRIOR ART | | | | | |
| STD-5 | 30.5 | 15.2 | 1706 | 2903 | 0.59 |
| HC-5 | 40.5 | 25.4 | 2908 | 4839 | 0.60 |
| B/LB | 28.0 | 19.1 | 1462 | 2632 | 0.40 |
| B/S | 33.0 | 25.4 | 2387 | 4839 | 0.49 |
| STD-5SF | 30.5 | 14.0 | 1936 | 2903 | 0.62 |
| HC-5SF | 38.1 | 24.1 | 2594 | 4839 | 0.54 |
| Stone trench | 30.5 | 30.5 | 2510 | 5574 | 0.45 |
| PREFERRED INVENTION | | | | | |
| SW-5 | 30.5 | 15.2 | 2313 | 2903 | 0.80 |
| EQ-24 | 28.0 | 22.9 | 4192 | 5574 | 0.75 |
| SW-24 | 61.0 | 56.0 | 9897 | 10645 | 0.93 |
| SW-HC5 | 40.6 | 25.4 | 3992 | 4992 | 0.83 |

Thus, whereas prior art chambers have typical IA/TA in the range 0.40–0.62, in the invention a significantly greater ratio is achieved. As indicated, it is greater than 0.62, and for preferred chambers it is greater than 0.7, or more than 30% improved over the prior art chambers. (When they are present, web struts and certain ribs may decrease the real IA values, compared to those shown in Table 3 a small amount, but not by an amount that is material to the improvement provided by the invention.)

The chambers of the invention provide superior IA/TA due to the substantial perforation in the web area, in combination with the preferred combination of angles and dimensions. The degree or amount of perforation per unit area of a web sidewall is preferably approximately the same as it is for the adjacent valley and peak sidewall parts. However, a lesser degree of web perforation, but one that is still substantial—such as providing an infiltration area about 10% or more of the area of the web—is useful in the practice of the invention. Such might be employed, for example, to provide a web with higher strength.

Chambers must be efficiently shipped from the place of manufacture to the point of use and thus they are nested one within the other. When sidewalls are virtually vertical (very small angle $\phi$) or when chambers have too thick walls, or certain other design features, nesting is not good. Conversely, when walls are sloped with a high angle $\phi$, nesting is good, but vertical load resistance of the chamber is poor.

The preferred designs described above optimize the competing factors for nesting, as well, and identical chambers of the invention will nest one within the other so that the vertical height of two preferred chambers is no more than about 6.4 cm greater than the vertical height of one unit. Comparative data are shown in Table 4. For the preferred inventive chambers the nest height as a percent of chamber height is less than 16% preferably about 10%.

TABLE 4

| | Nesting heights of chambers | | |
|---|---|---|---|
| Product | Chamber Height (cm) | Incremental Nest Height (cm) | Nest Height as Percentage of Chamber Height |
| PRIOR ART | | | |
| STD-5 | 31 | 3.8 | 13 |
| HC-5 | 41 | 4.1 | 10 |
| B/LB | 28 | 5.3 | 19 |
| B/S | 33 | 5.6 | 17 |
| PREFERRED INVENTION | | | |
| STD-5 | 31 | 3.8 | 13 |
| SW-HC5 | 41 | 6.1 | 10 |
| EQ-24 | 28 | 4.6 | 16 |

Although only the preferred embodiment has been described with some alternatives, it will be understood that further changes in form and detail may be made without departing from the spirit and scope of the claimed invention. The geometric shapes which have been recited will in instances often be approximate. In particular, articles having rounding where there are intersecting parts, for molding, stress reduction or esthetic purposes are contemplated. Where planar shapes have been described, it will be understood that curving shapes may be substituted. While the invention is described in terms of leaching liquid into the soil, it will be evident the principles and invention are applicable to gathering liquids from the soil.

We claim:

1. In a chamber, for dispersing or gathering liquids within soil, of the type having an arch shape cross section, wherein the top of the chamber corresponds with the top of the arch shape cross section; having a multiplicity of alternating peaks and valleys running along the arch shape in the cross sectional plane direction; having a sidewall wherein the peaks and valleys thereof have perforations to enable passage of liquids into the surrounding soil; and, wherein webs connect adjacent peaks and valleys at intersections; the improvement comprising: at least one of said webs having perforations, to enable the passage of liquid through the web sidewall and into the soil.

2. The chamber of claim 1 wherein the perforations provide the peaks, valleys and webs with a substantially similar degree of open area for passage of liquid.

3. The chamber of claim 1 wherein the web sidewall perforations are horizontal slots.

4. The chamber of claim 1 characterized by the web with perforations having an upwardly-running step; and, a rib running upwardly along the web, adjacent and parallel to the step.

5. The chamber of claim 1 characterized by said web with perforations having a strut running diagonally, from the intersection where the web connects with the peak to the intersection where the web connects with the valley.

6. The chamber of claim 6 characterized by said web with perforations having a zig-zag pattern of struts.

7. The chamber of claim 1 characterized by a sidewall having upwardly running ribs proximate the intersections of each web with the adjacent peak and valley parts.

8. The chamber of claim 7 wherein a rib proximate the intersection of a peak and web with perforations is displaced a short distance longitudinally along the length of the chamber from said intersection, toward the center of the peak.

9. The chamber of claim 1 characterized by substantially planar sidewalls, wherein the valley and peak parts of the sidewall are shaped substantially as trapezoids; and, wherein the webs are shaped substantially as parallelograms.

10. The chamber of claim 1 characterized by legs extending from one end and pockets attached to the opposing end, to enable chambers having like features to mate together in interlocked fashion and transfer loads there between.

11. The chamber of claim 1 having a sidewall comprised of two adjacent peaks and two webs with perforations connecting said peaks to the valley therebetween; wherein, when measured at the vertical midpoint of the perforated portion of the sidewall, the horizontal length of perforated sidewall surface between the two adjacent peaks is greater than the point to point horizontal distance between the two adjacent peaks.

12. A chamber for dispersing or gathering liquids within the soil, comprising: an arch shape cross section; sloped sidewalls of substantially identical shape on opposing sides of said cross section, defining a hollow interior for receiving liquids; a top corresponding with the top of the arch; a base corresponding with the base of the arch; the chamber having a length and corresponding longitudinal axis running perpendicular to the arch shape cross section; the sidewalls having multiple perforations, to enable the passage of liquids therethrough; alternating peaks and valleys running up the sidewalls and along the arch shape in the plane of said cross section; characterized by alternating peaks and valleys connected at intersections by webs having perforations; by webs having a web sidewall angle B of 12–20 degrees, as the angle B is measured in a horizontal plane between a vertical cross sectional plane of the chamber and the nominal plane of the web; by peaks having sidewall angles $\phi$ of 15–19 degrees, as the angle $\phi$ is measured between the peak sidewall exterior surface and a vertical plane containing said longitudinal axis; and, by peaks having peak-web intersection angles S of 9–15 degrees, as the angle S is measured between the line of the peak-web intersection and a vertical cross section plane of the chamber.

13. The chamber of claim 12 characterized by an angle B of 15–20 degrees and an angle S of 9–10 degrees.

14. The chamber of claim 12 characterized by substantially planar sidewalls, wherein the valley and peak parts of the sidewall are shaped substantially as trapezoids; and, wherein the webs are shaped substantially as parallelograms.

15. The chamber of claim 12 wherein, when two identical chambers are mated to make one chamber nest within the other, the overall height of the combined chambers is less than about 16 percent greater than the height of one chamber by itself.

16. The chamber of claim 12 wherein, when measured at the vertical midpoint of the perforated portion of the sidewall, the horizontal length of perforated sidewall surface between two adjacent peaks is greater than the point to point horizontal distance between the two adjacent peaks.

17. A chamber for burial in soil to disperse or gather liquids within the soil, comprising: a hollow arch shape cross section interior, to receive liquids; opposing sidewalls having alternating peaks and valleys running along the arch shape in the direction of the cross section plane, connected by webs, the sidewalls having perforations to enable the passage of liquids therethrough; the chamber having a length and corresponding longitudinal axis, wherein the top of the chamber corresponds with the top of the arch shape cross section; at least one sidewall having an Infiltration Area (IA) to Total Area (TA) ratio (IA/TA) greater than 0.62, where IA is the surface area of soil lying within all perforations along a unit length of chamber when the slope of the soil surface runs from the bottom surface of each perforation at the interior of the chamber to the top surface of each perforation at the exterior of the chamber; wherein TA is the unit length area of said at least one sidewall measured along the surface thereof.

18. The chamber of claim 17 wherein the ratio IA/TA is at least about 0.7.

19. The chamber of claim 17 wherein the sidewall has louvered slot perforations.

20. The chamber of claim 17 characterized by peaks having sidewall angles $\phi$ of 15–19 degrees, as the angle $\phi$ is measured between the peak sidewall exterior surface and a vertical longitudinal plane of the chamber which contains said longitudinal axis.

21. The chamber of claim 17 further characterized by webs having a web sidewall angle B of 12–20 degrees, as the angle B is measured in a horizontal plane between a vertical cross sectional plane of the chamber and the nominal plane of the web; by peaks having sidewall angles $\phi$ of 15–19 degrees, as the angle $\phi$ is measured between the peak sidewall exterior surface and a vertical longitudinal plane of the chamber; and, by peaks having peak-web intersection angles S of 9–15 degrees, as the angle S is measured between the line of the peak-web intersection and a vertical cross section plane of the chamber.

22. A chamber for burial in soil to disperse or gather liquids within the soil, comprising: a hollow arch shape cross section interior, to receive liquids; sidewalls comprised of alternating peaks and valleys running along the arch shape in the direction of the plane of the cross section, connected by webs; the sidewalls including the web portions having perforations to enable the passage of liquids therethrough; the chamber having a length L and corresponding longitudinal axis; wherein the top of the chamber corresponds with the top of the arch shape; wherein, in the horizontal plane running through the vertical midpoint of the perforated portions of the sidewalls, the chamber has a valley depth, j, as measured in the chamber cross sectional plane, and a peak length, k, as measured along the length of the chamber; characterized by a ratio j/k of at least about 0.35.

23. The chamber of claim 22 characterized by a ratio j/k of greater than about 0.5.

24. The chamber of claim 22 wherein the sidewall has slot perforations along the peaks, webs and valleys.

25. The chamber of claim 22 characterized by a ratio j/l of at least about 0.053, where l is a one meter unit length of a chamber.

26. The chamber of claim 22 characterized by a ratio of k/l less than about 0.08.

27. The chamber of claim 22 further characterized by a sidewall having an Infiltration Area (IA) to Total Area (TA) ratio (IA/TA) greater than 0.62, where IA is the surface area of soil lying within all perforations along a unit length of chamber when the slope of the soil surface runs from the bottom surface of each perforation at the interior of the chamber to the top surface of each perforation at the exterior of the chamber; and, where TA is the unit length area of the sidewall measured along the surface thereof.

* * * * *

UNITED STATES PATENT AND TRADEMARK OFFICE

CERTIFICATE OF CORRECTION

PATENT NO. : 5,511,903

DATED : April 30, 1996

INVENTOR(S) : James M. Nichols, Bryan A. Coppes, Bruce T. Sperry, Jr.

It is certified that error appears in the above-indentified patent and that said Letters Patent is hereby corrected as shown below:

In claim 6, line 1, change "6" to --5--

Signed and Sealed this

Ninth Day of July, 1996

*Attest:*

Bruce Lehman

BRUCE LEHMAN

*Attesting Officer*

*Commissioner of Patents and Trademarks*